US008814117B2

(12) United States Patent
Bohanan et al.

(10) Patent No.: US 8,814,117 B2
(45) Date of Patent: Aug. 26, 2014

(54) CLAMPING ACCESSORY STORAGE DEVICE

(75) Inventors: Jeff S. Bohanan, Powell, TN (US); William M. Reid, Knoxville, TN (US)

(73) Assignee: Protomet Corporation, Oak Ridge, TN (US)

( * ) Notice: Subject to any disclaimer, the term of this patent is extended or adjusted under 35 U.S.C. 154(b) by 0 days.

(21) Appl. No.: 13/584,538

(22) Filed: Aug. 13, 2012

(65) Prior Publication Data

US 2013/0037677 A1 Feb. 14, 2013

Related U.S. Application Data

(60) Provisional application No. 61/522,925, filed on Aug. 12, 2011.

(51) Int. Cl.
*A47G 1/10* (2006.01)

(52) U.S. Cl.
USPC ..... 248/316.1; 248/276.1; 211/70.5

(58) Field of Classification Search
USPC ..... 248/313, 316.1, 316.5, 276.1, 284.1, 248/286.1; 211/70.5, 85.7, 89.01
See application file for complete search history.

(56) References Cited

U.S. PATENT DOCUMENTS

| | | | | |
|---|---|---|---|---|
| 5,009,134 | A | 4/1991 | Sorenson et al. | |
| 5,022,137 | A | 6/1991 | Sorenson et al. | |
| 5,316,192 | A * | 5/1994 | Ng | 224/324 |
| 6,886,795 | B2 * | 5/2005 | Schultz | 248/316.2 |
| 7,213,713 | B2 * | 5/2007 | Matsui | 211/85.7 |
| 7,770,859 | B2 * | 8/2010 | Costabel et al. | 248/316.5 |
| 7,866,620 | B2 * | 1/2011 | Kaemmer | 248/311.2 |
| 8,181,928 | B2 * | 5/2012 | Ruan | 248/316.1 |
| 2008/0203260 | A1 * | 8/2008 | Carnevali | 248/316.5 |
| 2010/0230574 | A1 * | 9/2010 | Ruan | 248/511 |
| 2012/0280102 | A1 * | 11/2012 | Liu | 248/316.5 |

* cited by examiner

*Primary Examiner* — Steven Marsh
(74) *Attorney, Agent, or Firm* — Pitts & Lake, P.C.

(57) ABSTRACT

A storage device including a body defining at least one receiver and at least one clamping member. The clamping member includes a first position for receiving an accessory for storage and a second position to apply force to secure an accessory to the receiver for storage. A handle actuator may actuate movement of the clamping member. The clamping member may translate from the first position to the second position to apply force to secure an accessory for storage. The clamping member may be held in the secure position by a releasable braking lever.

8 Claims, 8 Drawing Sheets

CLAMPING ACCESSORY STORAGE DEVICE

CROSS-REFERENCE TO RELATED APPLICATIONS

This application claims the benefit of U.S. Provisional Application No. 61/522,925 filed Aug. 12, 2011.

FIELD OF INVENTIVE CONCEPT

The present inventive concept relates generally to a device used to hold and store accessories on a boat.

BACKGROUND

The sport of wakeboarding evolved as a derivative from skiing and surfing. The evolution began in 1985 and; at various stages in the evolution, it was called "skurfing" or "skiboarding". Eventually, these names gave way to the official name of "wakeboarding".

More recently, the sport of wakeboarding has seen some other spinoffs or variations which include wakeskating and surfing. These sports utilize different types of boards and these boards can vary in length, weight, and thickness depending on a manufacturer's specific design.

Boats designed specifically for wakeboarding include a tower to elevate the tow rope.

To maximize space in the passenger compartment, it is desirable to store wakeboard or board like accessories up and away from the passengers. In addition to elevating the tow rope, the tower is also used to store accessories up and away from the passengers.

In recent years, numerous designs for holding accessories have been developed for mounting to the tower or directly to the boat.

These rack systems are often referred to as wakeboard racks but are also used to hold skis, wakeskates, surfboards, or other recreational accessories. These racks generally accommodate wakeboards which vary in length, width, and thickness. Accessories other than wakeboards introduce additional variations in length, width, and thickness.

Most board storage accessories utilize a pair of fork-like devices to cradle the boards. The cradle is often referred to as a "board fork". Often, the board forks include 1 or more slots for storage of 1 or more boards at a time.

Currently, there are two primary methods for holding the boards secure in the board forks. The board forks are generally equipped with either an elastic cord or a clamping mechanism which secures the board in place.

The conventional methods for holding the boards in place is complicated by the need for the board fork to accommodate and secure boards of varying lengths, widths, and thicknesses. The various board widths and lengths can generally be accommodated by an open fork design where the width of the open fork accommodates the widest accessory to be stored.

The elastic cord method of securing the board accommodates various board widths and thicknesses within the range of the elasticity of the cord. This method is cumbersome to perform as the user must generally pull the attached cord around the outside of the boards and attach the 2nd end of the cord to a stationary hook. Also, the board is generally free to move or vibrate within the elastic range of the cord and within the width range of the open forks.

A second method of securing a board is to clamp the boards in place. The most common method of clamping a board in place is depicted in U.S. Pat. No. 6,886,795. An aspect of this patent is to utilize a spring-bias system to hold a board securely in place. Although the system allows a user to use one locking handle to actuate two clamping members that may be clamping on boards of varying widths, the boards have a tendency to lift up or vibrate as the forward motion of the boat generates a wind force that overcomes the force of the springs.

BRIEF SUMMARY

Example embodiments of the present general inventive concept can be achieved by providing an accessory storage device including a body defining at least one receiver and at least one clamping member. The at least one clamping member can have a first position for receiving an accessory for storage and a second position to apply force to secure an accessory for storage.

A handle actuator may actuate movement of the at least one clamping member. The at least one clamping member may pivot from a first position to a second position to apply force to secure an accessory for storage. The clamping member may be held in the secure position by a releasable braking lever.

When the releasable braking lever is released, a spring may be used to return the clamping member to an open position.

In some embodiments containing two or more clamping members, a linkage bar may be employed to coordinate the motion of the clamping members. The linkage bar may be designed to allow for relative motion of the clamping members.

The relative motion of the clamping members may allow the storage device to secure at least one accessory in the first receiver when the second receiver does not contain an accessory or vice versa. The relative motion of the clamping members may allow the storage device to secure accessories of a specified thickness in the first receiver while securing accessories of a different thickness in the second receiver.

BRIEF DESCRIPTION OF THE FIGURES

The following example embodiments are representative of exemplary techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the exemplary embodiments, with reference to the accompanying drawings in which.

DETAILED DESCRIPTION

Reference will now be made to the example embodiments of the present general inventive concept, examples of which are illustrated in the accompanying drawings and illustrations. The example embodiments are described herein in order to explain the present general inventive concept by referring to the figures.

Figure 1:
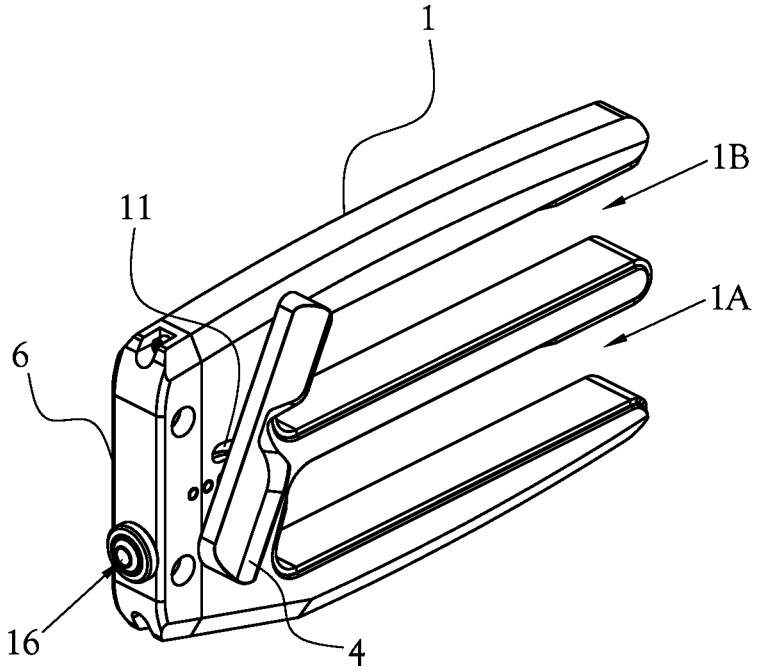
FIG. 1 is an isometric view of a clamp rack assembly shown in an undamped position according to an example embodiment of the present general inventive concept.
Figure 2:
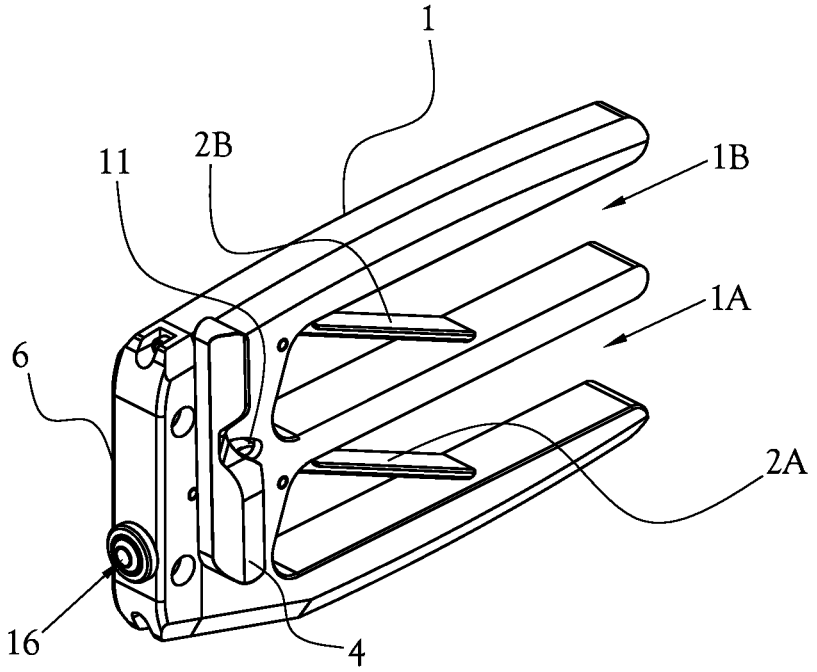
FIG. 2 is an isometric view of a clamp rack assembly shown in a clamped position according to an example embodiment of the present general inventive concept.

FIGS. 1 and 2 illustrate example embodiments of the present general inventive concept. FIG. 1 depicts an accessory storage device with a Receiver Body 1 which contains a Lower Receiver Opening 1A and an Upper Receiver Opening 1B. The Receiver Body 1 is designed to accept and secure a stored accessory. The Lower Clamp Lever 2A and Upper Clamp Lever 2B cannot be seen in FIG. 1 as they are retracted into the Receiver Body 1 and are resting in the undamped position. FIG. 2 depicts Receiver Body 1 with a Lower Clamp Lever 2A and an Upper Clamp Lever 2B pivoted into the clamped position. The Handle 4 rotation drives the Lower and Upper Clamp Levers 2A and 2B, via a drive pin 10 and drive slot 11 (see FIGS. 4 and 5) to rotate from an undamped position shown in FIG. 1 to a clamped position shown in FIG. 2. Pressing on the Release Button 16 releases the Braking Lever 7. When the Braking Lever 7 is released, the Torsion Spring 12 forces Lower Clamp Lever 2A and Upper Clamp Lever 2B into the undamped position.

Figure 3A:
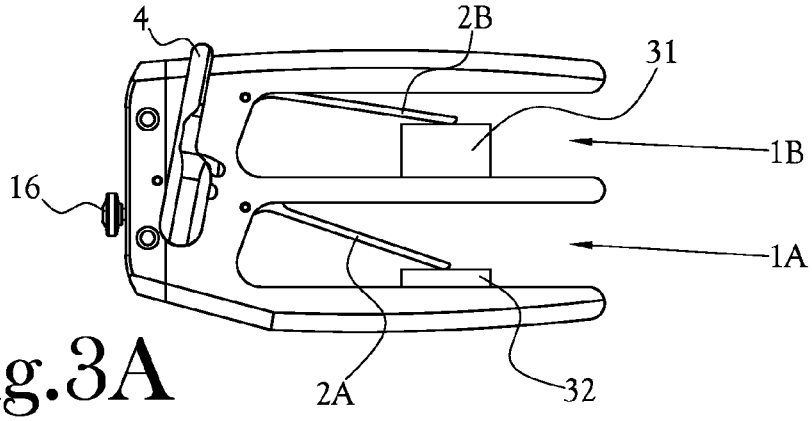
FIGS. 3A through 3C depict three possible accessory loading configurations according to an example embodiment of the present general inventive concept.
Figure 3B:
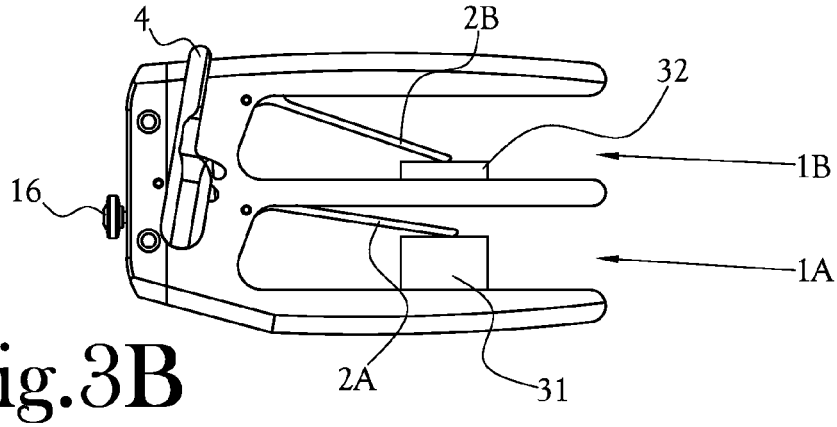
Figure 3C:
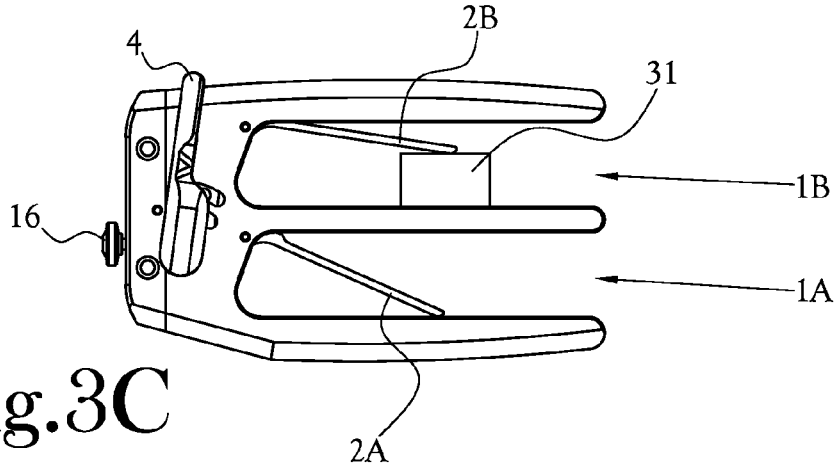

FIGS. 3A through 3C show examples of three potential configurations to store various combinations of accessories 31, 32 of varying thicknesses. The examples shown in FIGS. 3A to 3C depict the varying thicknesses of the accessories as thick accessory 31 and thin accessory 32, but the present general inventive concept is not limited to any particular thickness or combination of accessories. Moreover, although FIG. 3C illustrates a thick accessory 31 loaded in the top receiver opening 1B and no accessory in the empty bottom receiver opening 1A, the present general inventive concept is not limited to such configuration. The top receiver opening 1B could be empty and the bottom receiver opening 1A could be loaded without departing from the present general inventive concept.

As illustrated in FIGS. 3A through 3C, Lower Clamp Lever 2A and Upper Clamp Lever 2B translate through varying degrees of rotation before engaging a stored accessory to provide the necessary clamping force to secure the stored accessory, depending on the thickness of a particular accessory and/or whether the receiver openings 1A, 1B are loaded or empty. The clamping force to Lower Clamp Lever 2A and Upper Clamp Lever 2B is provided through a Handle 4, and a Linkage Bar 3 is employed to facilitate relative motion of the clamp levers 2A, 2B driven by the handle 4, as described in more detail below.

Figure 4:
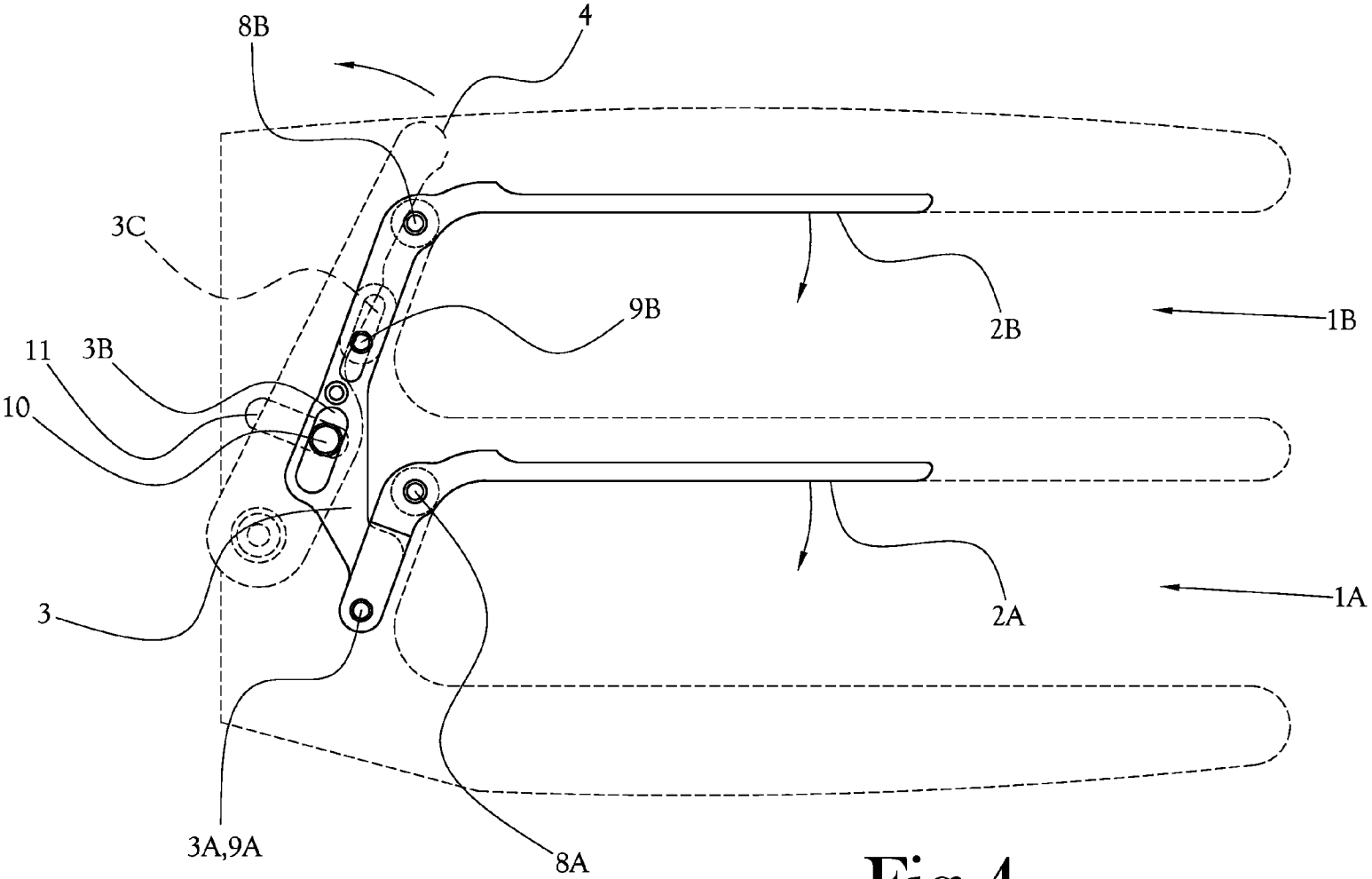
FIG. 4 is a section view of a clamp rack assembly in an undamped position according to an example embodiment of the present general inventive concept.
Figure 5:
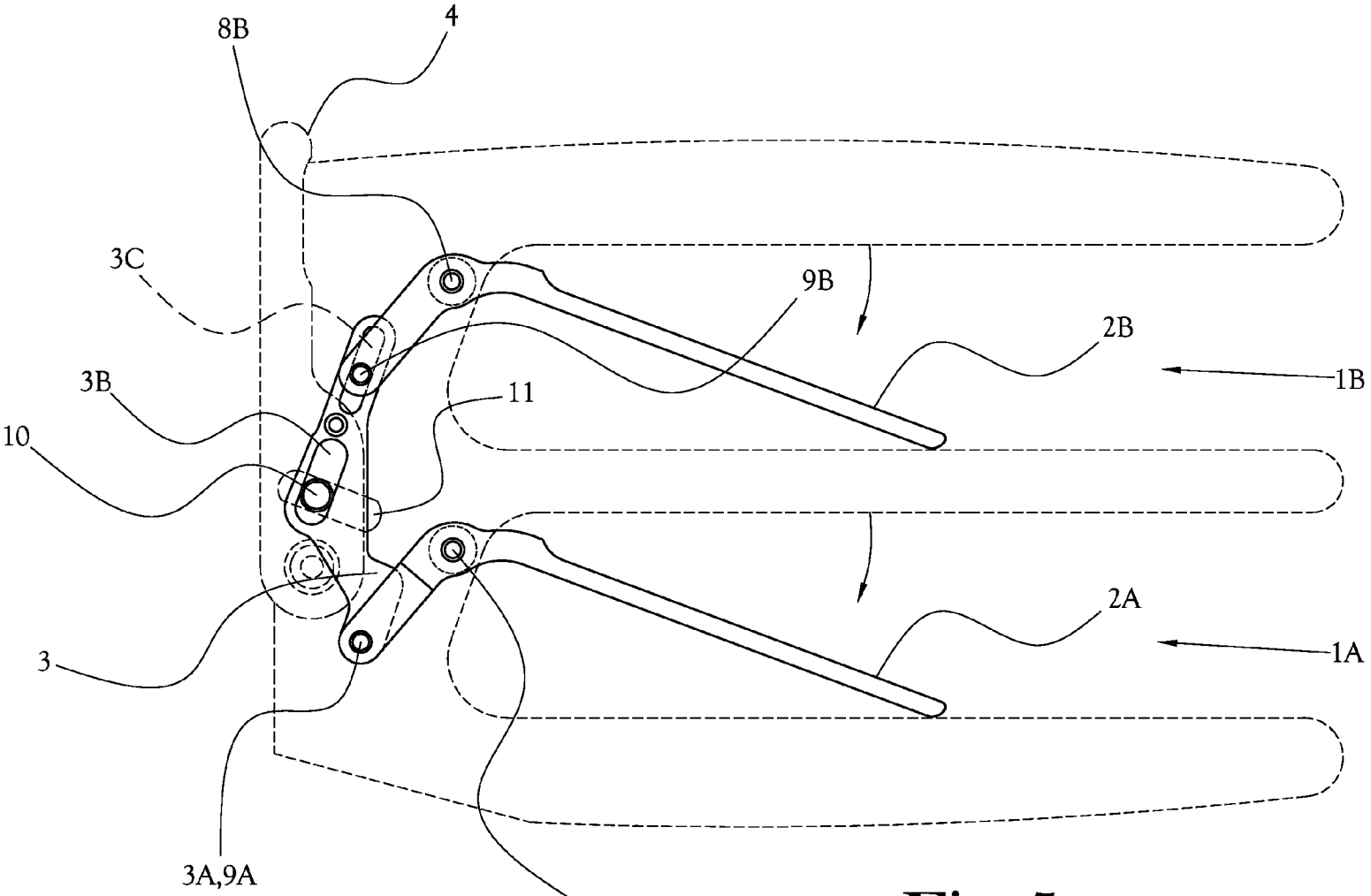
FIG. 5 is a section view of a clamp rack assembly in a clamped position according to an example embodiment of the present general inventive concept.

FIG. 4 depicts the clamp rack assembly mechanism in the undamped position, i.e., ready to receive an accessory. FIG. 5 depicts the clamp rack assembly mechanism in a fully clamped position against lower surfaces of the respective receiver openings 1A, 1B, demonstrating the full range of clamping motion when no accessories are present.

Referring to FIGS. 4 and 5, rotation of the Handle 4 from the first position of FIG. 4 to the second position of FIG. 5 forces the Drive Pin 10 from the right side of the drive slot 11 to the left side of the drive slot 11, causing the linkage bar 3 to drive the associated clamp levers 2A, 2B toward a clamping position. During this movement, as the Linkage Bar 3 is driven by the Handle 4 and Drive Pin 10, the Drive Pin 10 is permitted to slide along the Primary Slot 3B of the Linkage bar 3. The Linkage Bar 3 connects Lower Clamp Lever 2A and Upper Clamp Lever 2B through Lower Pin 9A and Upper Pin 9B. As the Linkage Bar 3 is driven by the Handle 4, and the clamp levers 2A, 2B begin to pivot towards a clamping position, the sliding motion of the Upper Pin 9B in the elongated Secondary Slot 3C serves to take up the system slack until Lower Clamp Lever 2A and Upper Clamp Lever 2B rotate and engage a stored accessory or come to rest on the base of their respective receiver opening.

Referring to FIGS. 4-5, the Handle 4 can be a formed as a lever and connected to the Slide Bar 5 via Slide Bar Bolt 23 and mounting element 50. The Handle 4 can include an opening to receive the Drive Pin 10, such that when the Handle is pivoted between the first position and the second position, the Drive Pin 10 drives the Linkage Bar 3 and the Slide Bar 5 slides with respect to the Braking Lever 7 through an Opening 7A in the releasable Braking Lever 7. In some embodiments the Slide Bar 5 can include a plurality of teeth, or notches, to help retain the Slide Bar 5 in a fixed position with respect to the Braking Lever 7 as the Handle 4 is pivoted. In this configuration, counterclockwise rotation of Handle 4 drives Slide Bar 5 and associated Drive Pin 10 to the left. Those skilled in the art will appreciate that the Handle 4 can take a variety of forms, and is not limited to the shape and size depicted in the example embodiments. For example, it is possible to form the Handle 4 as a simple extension of the Drive Pin 10 to actuate the clamping action.

Figure 6:
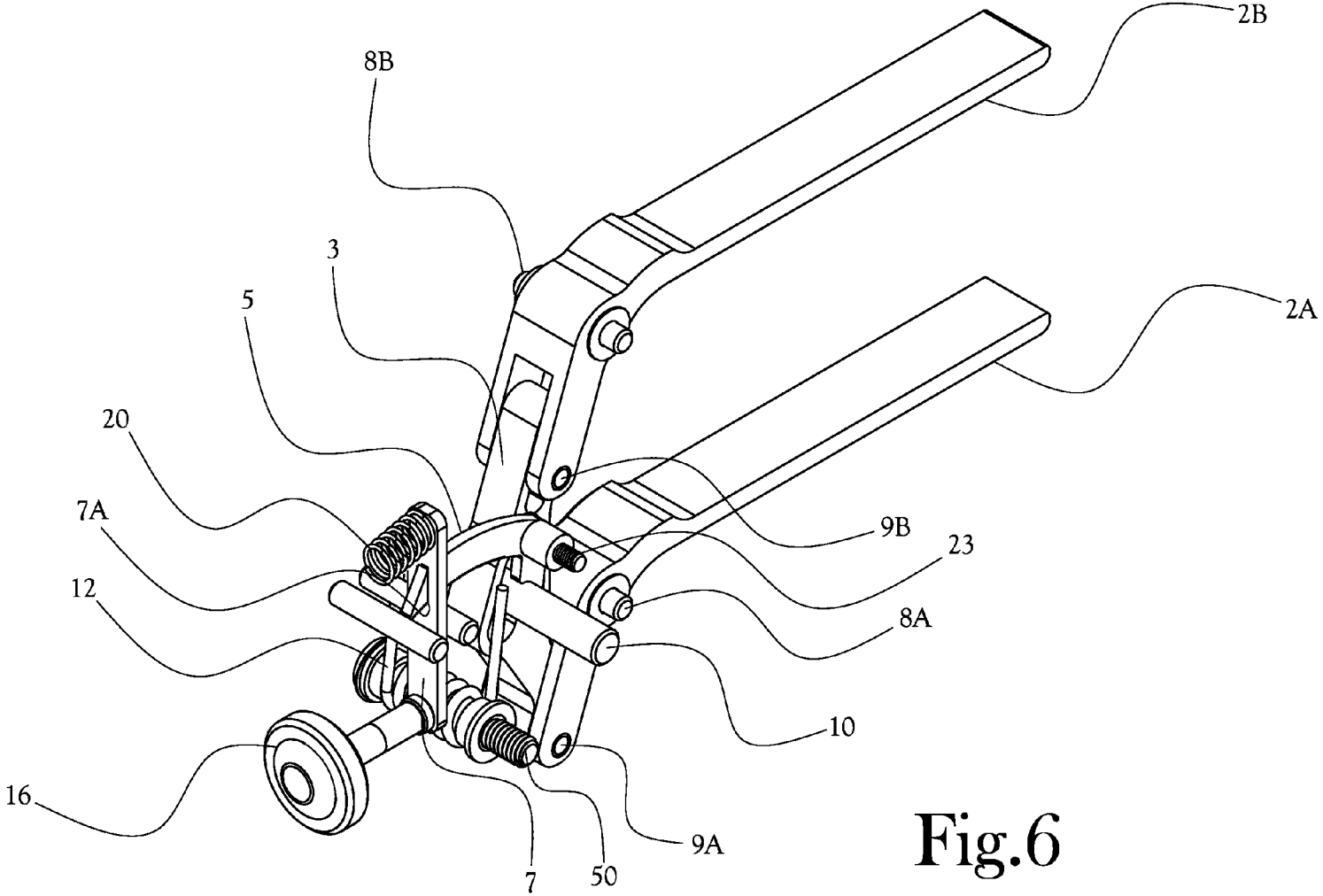
FIG. 6 is an isometric assembly view of a clamp rack mechanism according to an example embodiment of the present general inventive concept.

FIG. 6 is an isometric assembly view of a clamp rack mechanism according to an example embodiment of the present general inventive concept. Although the drive pin 10, linkage bar 3, and slide bar 5 are configured in shape and size to impart rotational movement to the clamps 2A, 2B, it is possible to configure the components using sound engineering judgment to impart linear motion to the clamps 2A, 2B. For example, the slide bar 5 could be formed as a straight piece, and the linkage bar 3 could be formed to impart linear (e.g., up and down) motion to the clamp members 2A, 2B, such that upon actuation of the drive pin 10, the linkage bar 3 actuates the clamps 2A, 2B to move the clamps linearly up and down with respect to the receiver portions, wherein the clamps remain substantially parallel to the receiver portions during the clamping action. A variety of configurations could be implemented using sound engineering judgment to carry out the releasable clamping action of one or more clamps, using rotational or linear action, or combinations thereof, and all such configurations are intended to be covered within the scope of the present general inventive concept.

Figure 7:
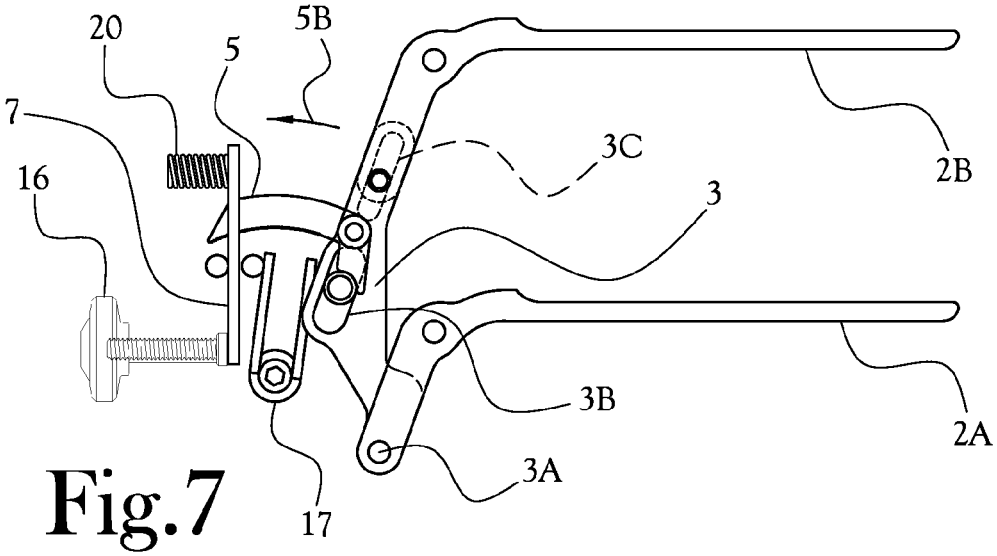
FIG. 7 is an assembly view of a clamp rack mechanism shown in an undamped position without the handle for clarity according to an example embodiment of the present general inventive concept.
Figure 8:
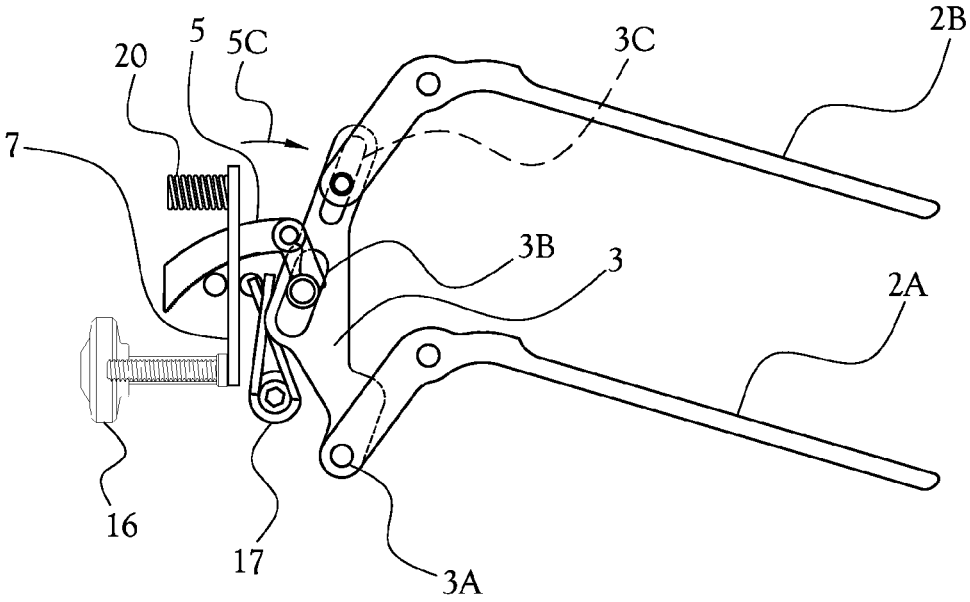
FIG. 8 is an assembly view of a clamp rack mechanism shown in a clamped position without the handle for clarity according to an example embodiment of the present general inventive concept.

FIG. 7 is an assembly view of a clamp rack mechanism shown in an undamped position, and FIG. 8 is an assembly view of a clamp rack mechanism shown in a clamped position, according to example embodiments of the present general inventive concept.

FIG. 8 depicts the clamp rack assembly mechanism in a clamped position. In FIG. 8, Slide Bar 5 passes through an Opening 7A in Braking Lever 7. Braking Lever 7 is hanging in suspension on Slide Bar 5 and is pivotably captured by the Compression Spring 20 and the Release Button 16. Compression Spring 20 provides a rotational bias to the upper end of Braking Lever 7. The rotational position of Braking Lever 7 is limited by the binding interference of Opening 7A with the edges of Slide Bar 5. As mentioned above, it is possible to for the Slide Bar 5 to include a plurality of teeth, or notches, to interact with the opening 7A, to help retain the Slide Bar 5 in a fixed position with respect to the Braking Lever 7 when the Handle 4 is released.

It should be noted that in the standby position depicted in FIG. 7, the Braking Lever 7 is substantially perpendicular to the longitudinal axis of Slide Bar 5 whereas the portion of the Braking Lever 7 which engages the Slide Bar 5 is substantially transverse to the longitudinal axis of Slide Bar 5. In this condition, if a force is applied to Slide Bar 5 in the direction of Arrow 5B by moving the handle 4 (not shown in FIG. 7) counterclockwise, Slide Bar 5 moves through Opening 7A because Braking Lever 7 is free to pivot against Compression Spring 20. Slide Bar 5 may be freely advanced in the direction of Arrow 5B until Lower Clamp Lever 2A and Upper Clamp Lever 2B reach the limits of their rotation by engaging a stored accessory or the base of a Lower or Upper Receiver Opening 1A or 1B.

However, in the standby position depicted in FIG. 8, if a force is applied in a direction opposite to Arrow 5B in the direction of Arrow 5C, the edges of Opening 7A bind against the surface of Slide Bar 5 and it is not possible, without further action, to advance Slide Bar 5 in the direction of Arrow 5C.

Compression of Compression Spring 20 by pressing on Release Button 16, returns Braking Lever 7 to a substantially perpendicular position and allows Slide Bar 5 to advance in either direction.

Torsion Spring 17 is biased to force Slide Bar 5 in the direction of 5C. With no external force being transferred to Slide Bar 5, Torsion Spring 7 will force Slide Bar 5 in the direction of Arrow 5C and Slide Bar 5 attached to Linkage Bar 3 will force Linkage Bar 3 to release Lower Clamp Lever 2A and Upper Clamp Lever 2B into the unclamped position.

Figure 9:
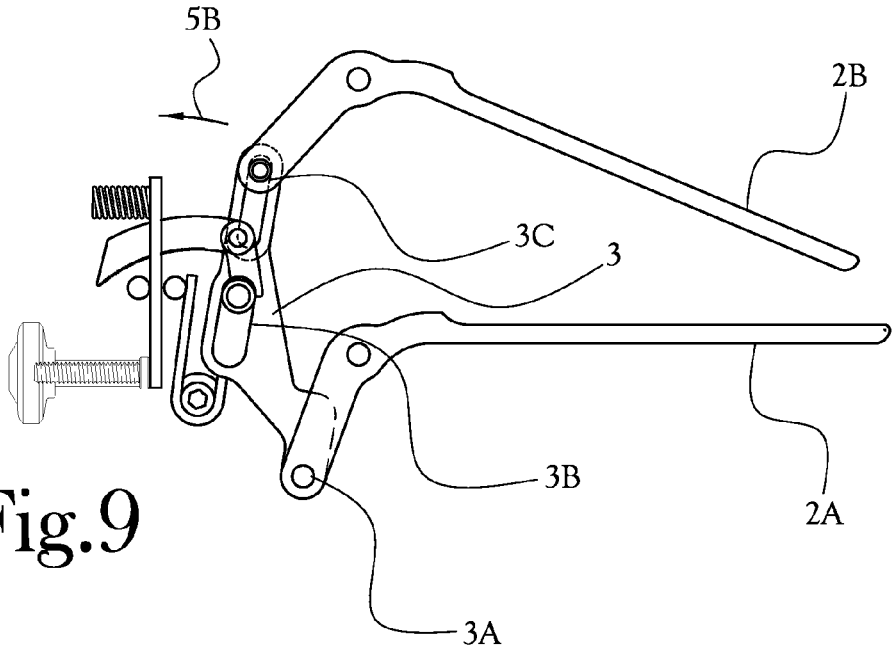
FIG. 9 is an assembly view of a clamp rack mechanism shown in a clamped position with the upper clamp lever moving through full range of motion while lower clamp lever is held up. Figure is shown without the handle for clarity according to an example embodiment of the present general inventive concept.

FIG. 9 is an assembly view of a clamp rack mechanism shown in a clamped position with the upper clamp lever moving through full range of motion while lower clamp lever is held up. Figure is shown without the handle for clarity according to an example embodiment of the present general inventive concept.

Figure 10:
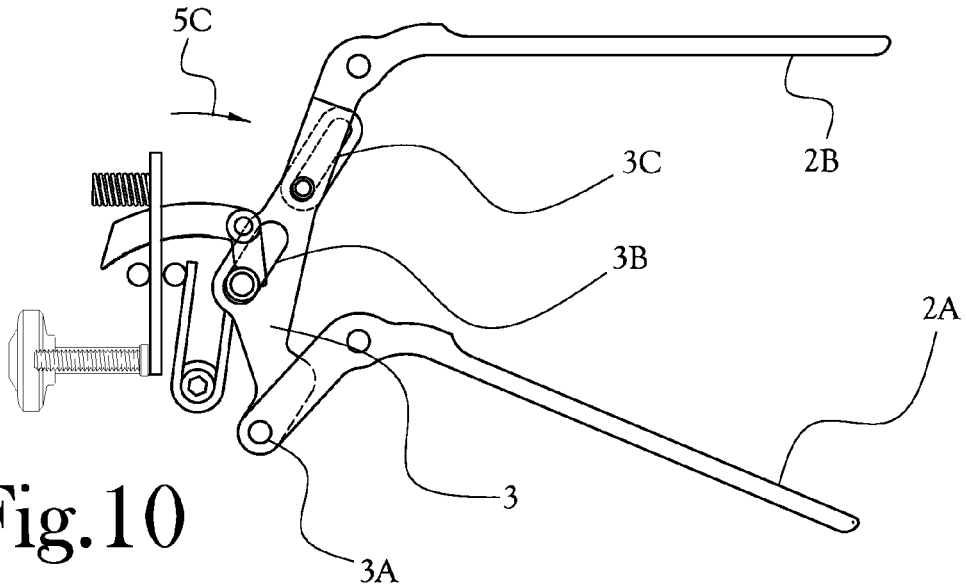
FIG. 10 is an assembly view of a clamp rack mechanism shown in a clamped position with the upper clamp lever held up while lower clamp lever is moved through the full range of motion. Figure is shown without the handle for clarity according to an example embodiment of the present general inventive concept.

FIG. 10 is an assembly view of a clamp rack mechanism shown in a clamped position with the upper clamp lever held up while lower clamp lever is moved through the full range of motion. Figure is shown without the handle for clarity according to an example embodiment of the present general inventive concept.

Referring to FIGS. 9 and 10, rotation of the Handle 4 from the first position to the second position moves the Drive Pin 10 to the left, causing the linkage bar 3 to drive the associated clamp levers 2A, 2B toward a clamping position. Since the Linkage Bar 3 connects Lower Clamp Lever 2A and Upper Clamp Lever 2B as described in connection with FIGS. 4 and 5, the elongated slots 3C, 3B serve to take up the system slack when different thickness accessories are clamped, allowing one or the other of the clamp levers 2A, 2B to continue to move, even if one of the clamps has already met resistance from a thicker accessory.

Figure 11:
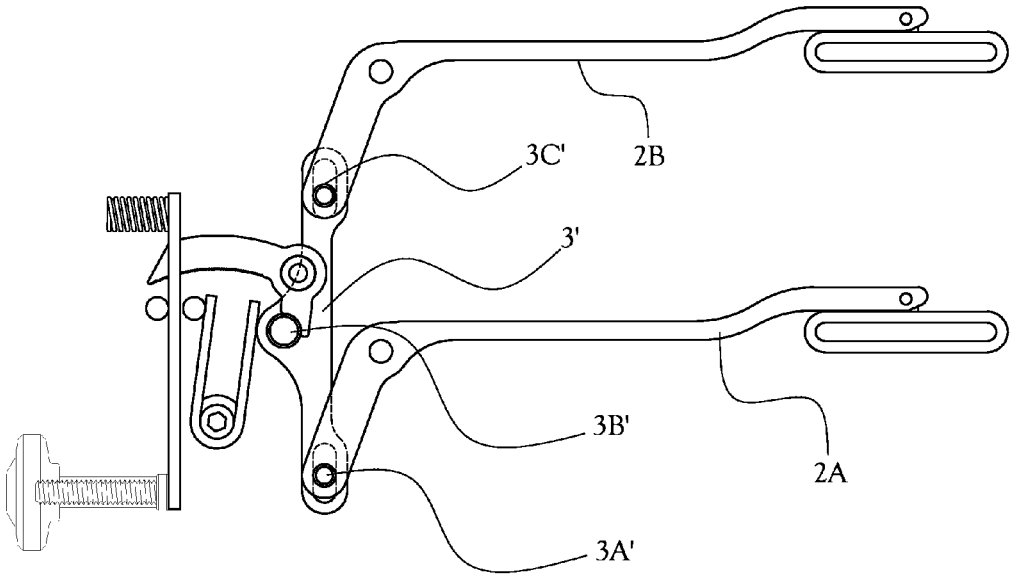
FIG. 11 is an assembly view of a clamp rack mechanism with a linkage bar assembly configured according to another embodiment of the present general inventive concept.

FIG. 11 is an assembly view of a clamp rack mechanism with a linkage bar assembly configured according to another embodiment of the present general inventive concept. In contrast to the linkage bar 3 illustrated in FIGS. 4 and 5, the linkage bar 3' of FIG. 11 includes a circular opening 3B' (instead of elongated Primary Slot 3B) to receive the Drive Pin 10, and a pair of elongated secondary slots 3A', 3C' drivably connected to a respective clamp lever 2A, 2B. During movement of the handle 4 (not shown in FIG. 11, but similar to FIGS. 4 and 5), rotation of the Handle 4 from the first position to the second position of forces the Drive Pin 10 from the right side of the drive slot 11 to the left side of the drive slot 11, causing the linkage bar 3' to drive the associated clamp levers 2A, 2B toward a clamping position by the pivotal movement of the ends of the linkage bar 3', which in turn pivot the associated claim members 2A, 2B via the secondary slots. Here, the secondary slots provide slack for either the Lower Clamp Lever 2A or Upper Clamp Lever 2B rotate and engage a stored accessory, depending on the thickness of the respective accessories being stored in each receiver. For example, if accessories of different thicknesses are being clamped by the Upper Clamp Lever 2B and the Lower Clamp Lever 2A, the slack provided by the secondary slots 3A' and 3C' will enable the linkage bar 3' to continue to pivot until both clamp levers 2A, 2B have met resistance from the accessory being stored, and lock, as described above.

Certain example embodiments of the present general inventive concept can provide for the actuation of a single member that can initiate the rotation of one or more clamping members that will provide for the securing of one or more objects of the same or varying thickness, or for the securing of one object when a second or more objects is not present in the clamping device. The clamping mechanism can include a linkage bar that ties together two or more clamping members to drive the locking of the clamping members while allowing for securing objects of equal or varying thickness or for the securing of two or more objects when another object is not present in the clamping device.

The present general inventive concept provides design flexibility for various numbers of or configurations of clamp mechanisms. Design flexibility is also allowed for clamping and securing for purposes of storage or for other applications where clamping of one or more objects is required.

It is noted that the simplified diagrams and drawings do not illustrate all the various connections and assemblies of the various components, however, those skilled in the art will understand how to implement such connections and assemblies, based on the illustrated components, figures, and descriptions provided herein, using sound engineering judgment.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

While the present general inventive concept has been illustrated by description of several example embodiments, it is not the intention of the applicant to restrict or in any way limit the scope of the inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings.

The invention claimed is:

1. A storage device comprising:

a slide bar;

a releasable braking lever having an opening to accommodate the slide bar;

a driving member to drive the slide bar;

at least one receiver; and at least one clamp connected to the slide bar such that movement of the driving member drives the slide bar with respect to the releasable braking lever through the opening in the braking lever to drive the at least one clamp between a first position for receiving an object for storage in the at least one receiver and a second position to secure an object for storage in the at least one receiver such that the second position of the clamp provides force to secure the stored object, and the second position of the clamp is held in place by interaction of the releasable braking lever and slide bar.

2. The storage device of claim 1, wherein the releasable braking lever pivots.

3. The storage device of claim 1, further comprising:

a push button to rotate the releasable braking lever to release the releasable braking lever.

4. The storage device of claim 1, wherein the releasable braking lever is released by direct actuation.

5. The storage device of claim 1, wherein the releasable braking lever is locked by rotating the releasable braking lever about a pivot to create a binding force against an arm that is connected to the clamp.

6. A storage device comprising:

a linkage bar;

a driving member to drive the linkage bar;

at least two receivers; and at least two clamps that work with the at least two receivers and are moveable between a first position for receiving an object for storage and a second position to secure an object for storage, at least one of the clamps being connected to a first portion of the linkage bar and another one of the clamps being connected to a second portion of the linkage bar;

wherein upon actuation of the driving member, pivotal movement of the first and second portions of the linkage bar provide a force to pivot the at least two clamps from the first position to the second position to secure at least one stored object;

wherein the linkage bar cooperates with the at least two clamps to provide the force to store the at least one stored object in at least one of the receivers.

7. The storage device of claim 1, wherein the driving member is formed in the shape of a handle.

8. The storage device of claim 6, wherein the linkage bar includes at least one elongated slot to enable variable relative motion of the clamps so that an object of a specified thickness may be secured by the first clamp while an object of a different thickness may be secured by the second clamp or so the first receiver can store an object while the second receiver does not have an object.

* * * * *